United States Patent [19]

White

[11] 4,410,035

[45] Oct. 18, 1983

[54] CONDENSING APPARATUS AND METHOD FOR PRESSURIZED GAS

[76] Inventor: Jeffrey A. White, 1 Westmorland Rd., London, Ontario N6J 3N2, Canada

[21] Appl. No.: 295,713

[22] Filed: Aug. 24, 1981

[30] Foreign Application Priority Data

May 15, 1981 [CA] Canada ..... 377441

[51] Int. Cl.[3] ..... F28B 3/00

[52] U.S. Cl. ..... 165/111; 62/93; 62/89

[58] Field of Search ..... 165/111; 62/93; 417/243

[56] References Cited

U.S. PATENT DOCUMENTS 2,015,288 9/1935 Rosen ..... 62/93

3,818,718 6/1974 Freese ..... 62/93

*Primary Examiner*—William R. Cline

*Assistant Examiner*—John F. McNally

*Attorney, Agent, or Firm*—Frishauf, Holtz, Goodman, Woodward

[57] ABSTRACT

The invention relates to a novel vapor condensor apparatus and method for continuously stripping condensate from a supply of compressed gas using the cold weather approach. One or more condensing assemblies are employed, each one of which includes spaced apart inner and outer tubular sections which extend between the top and bottom of the assembly ends. The inner tubular section defines a first passageway for the passage of a heat-exchange cooling fluid therethrough. A second passageway through which the compressed gas passes is defined by the spacing between the inner and outer tubular sections. Condensate discharge means is located at the bottom end of the assembly for exhausting the condensate which forms in the second passageway.

20 Claims, 4 Drawing Figures

CONDENSING APPARATUS AND METHOD FOR PRESSURIZED GAS

BACKGROUND OF INVENTION

This invention relates to a method and apparatus for continuously collecting condensate from a supply of pressurized gas.

When producing a pressurized gas, the prepressurized gas which has a given vapour content is most commonly drawn into a rotary, axial or piston-type of compressor whereby it undergoes pressurization.

During pressurization, the temperature of a given mass of gas invariably increases and is due at least in part to the operating temperature of the compressor through which the gas being compressed must pass. Indeed, it is not uncommon for industrial air compressors of the piston-type variety operating in pressure ranges of 100–150 pounds per square inch (p.s.i.) to generate pressurized gas temperatures in excess of 400° F. In many applications, compressed gas temperatures of this magnitude are viewed as unacceptable and it is therefore quite common to employ one or more aftercoolers downstream of the compressor for lowering the compressed gas temperature.

The aftercoolers may take the form of a simple ambient air heat exchanger or a water-jacketed heat exchanger. Although the temperature of the pressurized gas is reduced, these heat exchangers are not intended nor are they capable of functioning as vapour condensor collectors since whatever condensation is produced in the aftercooler it is normally swept along with the throughput of the pressurized gas. Condensate which is formed is usually collected and drawn off from the stream of pressurized gas by means of a cyclone separator or other forms of condensate collectors specifically designed for that purpose.

When a confined stream of pressurized gas is permitted to cool along the length of its confining conduit, due to the conduit's own heat-exchange exposure to a cooling fluid such as water or ambient air, for example, the vapour in the compressed gas stream condenses therealong downstream of a point where the dew point of the compressed gas at a given temperature is in equilibrium with a given temperature of the cooling fluid. In the case of compressed air, where air driven tools are employed, this can result in the passage of water as condensate through the tool and cause premature wear in the tool resulting from a washing away of its lubricant. In extreme cases, the condensed water vapour may freeze as a result of its confining conduit being exposed to temperatures below 32° F.

There has been a need, therefore, to devise an apparatus and method for continuously collecting condensate from a supply of compressed gas which, using the cold temperature approach, is capable of collecting and withdrawing condensate where the temperature dew point of the vapour in the compressed gas is greater than the temperature of the cooling fluid in a simple and inexpensive manner.

For example, large quantities of compressed air have been traditionally used, in combination with water under pressure, to produce what is described as "man made" snow. Commonly, a aftercooler and cyclone separator as above described is employed. However, downstream of the separator, it is not uncommon for the stream of pressurized air to undergo further cooling with the result that additional water vapour is condensed. This condensate hopefully is discharged at the snowmaking nozzle but where it undergoes freezing, if sufficient quantities are built up, it can clog one or both of the supply conduits to the snowmaking gun or the snowmaking gun itself.

Since most on-slope compressed air supply conduits for making man-made snow are buried underground, the ground temperature about the conduit can generally be taken as being, at its lowest, slightly above the freezing point (0° C.). The actual production of man made snow, however, is normally only undertaken where the ambient air temperature is 0° C. or less and quite often, significantly less than 0° C. Ideally, therefore, in snowmaking operations, water condensate should be extracted from the pressurized air at a dew point temperature which is below the ground temperature so that as the pressurized air proceeds along the supply conduit, it does so at a temperature somewhat above the dew point temperature at which its water vapour will condense and collect. Optimally, the dew point temperature of the pressurized air used in such applications should be less than the existing ambient air temperature.

BRIEF SUMMARY OF INVENTION

While my novel condensing apparatus and method which involves the cold temperature approach is ideally suited for stripping water condensate from compressed air, its application need not be so restricted as it is also capable of withdrawing condensate from other pressurized gases than air. Further, it will be apparent that the cooling fluid which is necessarily in heat exchange with the pressurized gas or air, may, for example be a refrigerant, ambient air, water, or a suitable combination of these.

According to my invention, the vapour condensing apparatus used in continuously collecting condensate from a supply of compressed gas passing therethrough comprises at least one elongate condensing assembly that has a top and a bottom end. Each condensing assembly includes spaced apart inner and outer tubular sections which extend between the assembly ends. A first passageway in the assembly for the passage of the cooling fluid therethrough is defined by the interior of the inner tubular section. A second compressed air passageway in the assembly is defined by the spacing between the spaced apart inner and outer tubular sections. The bottom or "hot" end includes a compressed gas inlet manifold means which communicates with the second passageway. The top or "cold" end, on the other hand, includes a compressed gas outlet manifold means that similarly communicates with the second passageway. Condensate discharge means is also provided at the bottom end of the assembly for exhausting condensate collected in the second passageway.

The outer surface of outer tubular section can advantageously be ribbed or finned for example, to effect heat exchange between the ambient air and the compressed gas. Ambient air can also be passed through the first passageway as the cooling heat exchange fluid. It will also be apparent that other cooling mediums can be employed. For example, water can be used as the heat exchange fluid within the first passageway and externally of the outer tubular section, if desired.

In context of pressurized air being the pressurized gas which is at an elevated temperature relative to the ambient air temperature which may be used as the cooling fluid, the pressurized air is passed through the second passageway from the bottom of the assembly towards its top. While the assembly itself can be vertically positioned, I prefer that it be inclined for the reasons hereinafter described. Since the pressurized stream of air passing through the second passageway is in this example in heat-exchange with the ambient air about the outer tubular section, cooling of the pressurized air is achieved. Additional cooling of the pressurized air stream takes place as a result of the heat exchange between this stream and the cooling fluid in the first passageway which again, if desired, can be air at ambient temperature.

From the foregoing, it will be seen that once the dew point temperature of a pressurized gas flowing through the apparatus is in equilibrium with the cooling fluid temperature, and the pressurized gas continues to move upwardly along the second passageway, the vapour in the pressurized gas is caused to condense and move downwardly along the inner wall of the outer tubular member (and possibly the outer wall of the inner wall tubular member) in counter direction to the upward flow of compressed gas.

By inclining the condensing apparatus, when condensate forms, it tends to collect along the lowermost inclined position of the second passageway and thence downwardly towards its lower end where evacuation of the condensate so collected takes place using suitable discharge means.

If the velocity of compressed gas through the second passageway is too great, there may not be sufficient heat exchange with the cooling fluid for a given length of the assembly to cause condensation. This can be readily dealt with by either dimensioning the second passageway so that its size, length or both will promote the production of condensate within a given temperature range or by reducing the velocity of the pressurized air passing therethrough. In this latter regard, and in accordance with a further embodiment of my invention, the condensing apparatus may be constructed from a plurality of condensing assemblies of the aforementioned description which are arranged in parallel and wherein the compressed gas inlet manifold means of each is connected to a common compressed gas inlet header, and the compressed gas outlet manifolds of each is similarly connected to a common compressed gas outlet header.

BRIEF DESCRIPTION OF DRAWINGS

In the accompanying drawings which illustrate one specific working embodiment of my invention.

DETAILED DESCRIPTION OF DRAWINGS

Figure 4:
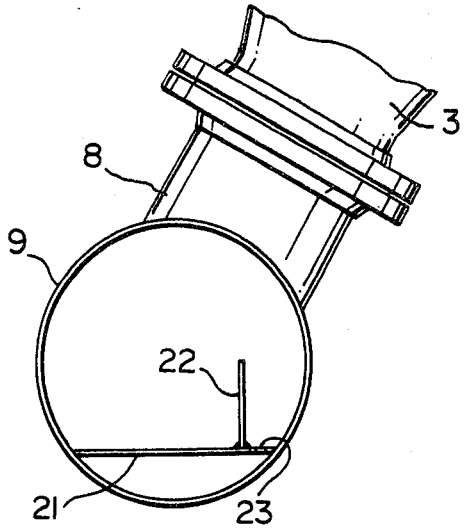
FIG. 4, appearing on the same sheet of drawings as FIG. 1, is a cross sectional view of the inlet header taken along the line IV—IV of FIG. 2.

The vapour condensing apparatus illustrated in these drawings is directed towards an apparatus which employs, in parallel, two condensing assemblies 1 although it is to be understood that, depending upon the pressurized gas throughput, only one or more than two assemblies can be employed. For ease of understanding, similar reference numerals have been used to identify identical component parts in the drawings.

Each assembly 1 has a top end and bottom end and is constructed from an inner tubular section 2 and an outer tubular section 3. Preferably, inner section 2 is coaxial with tubular section 3 and is held in spaced relationship therefrom by any suitable means such as radially spaced apart spacing ribs 5.

Figure 1:
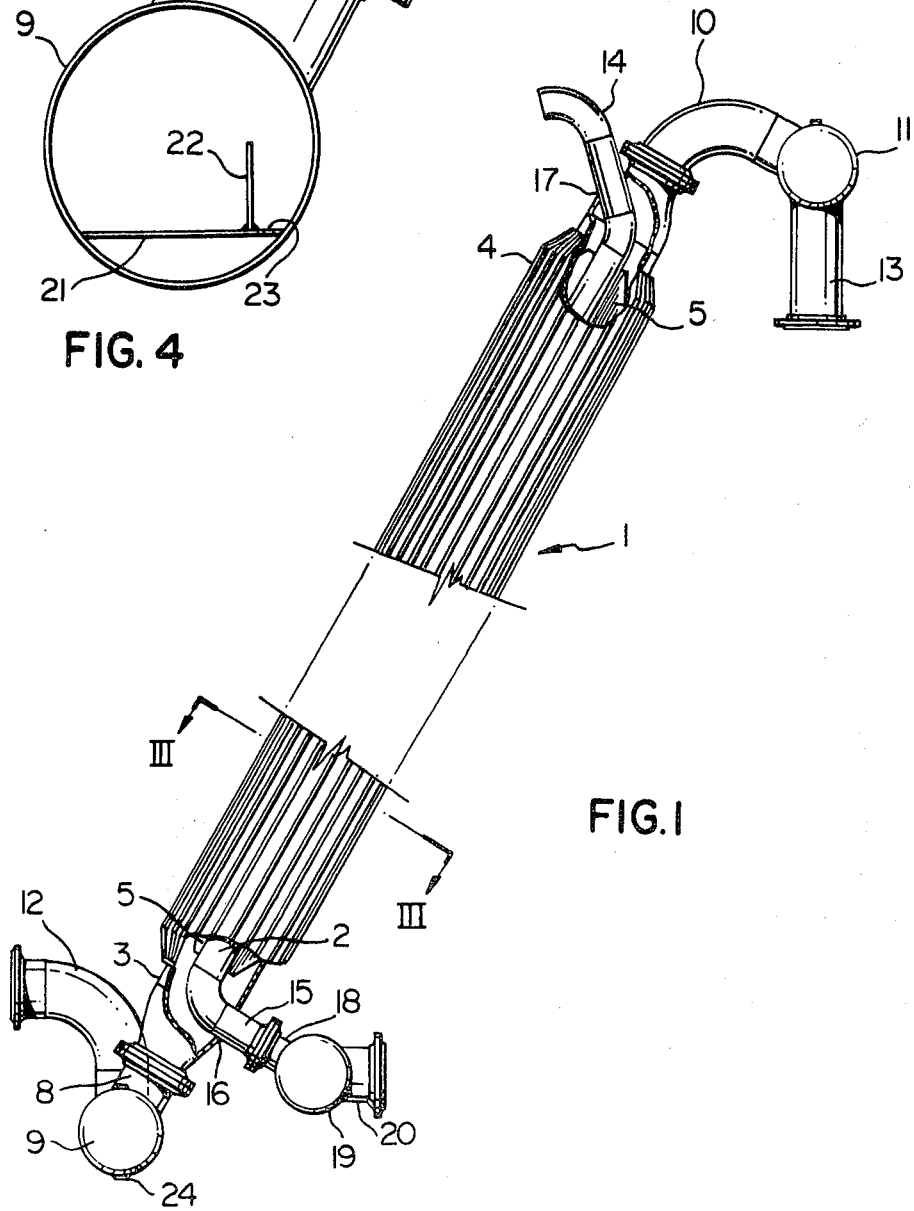
FIG. 1 is a side view of the condensor assembly with internal portions of it cut away for ease of understanding.
Figures 2, 3:
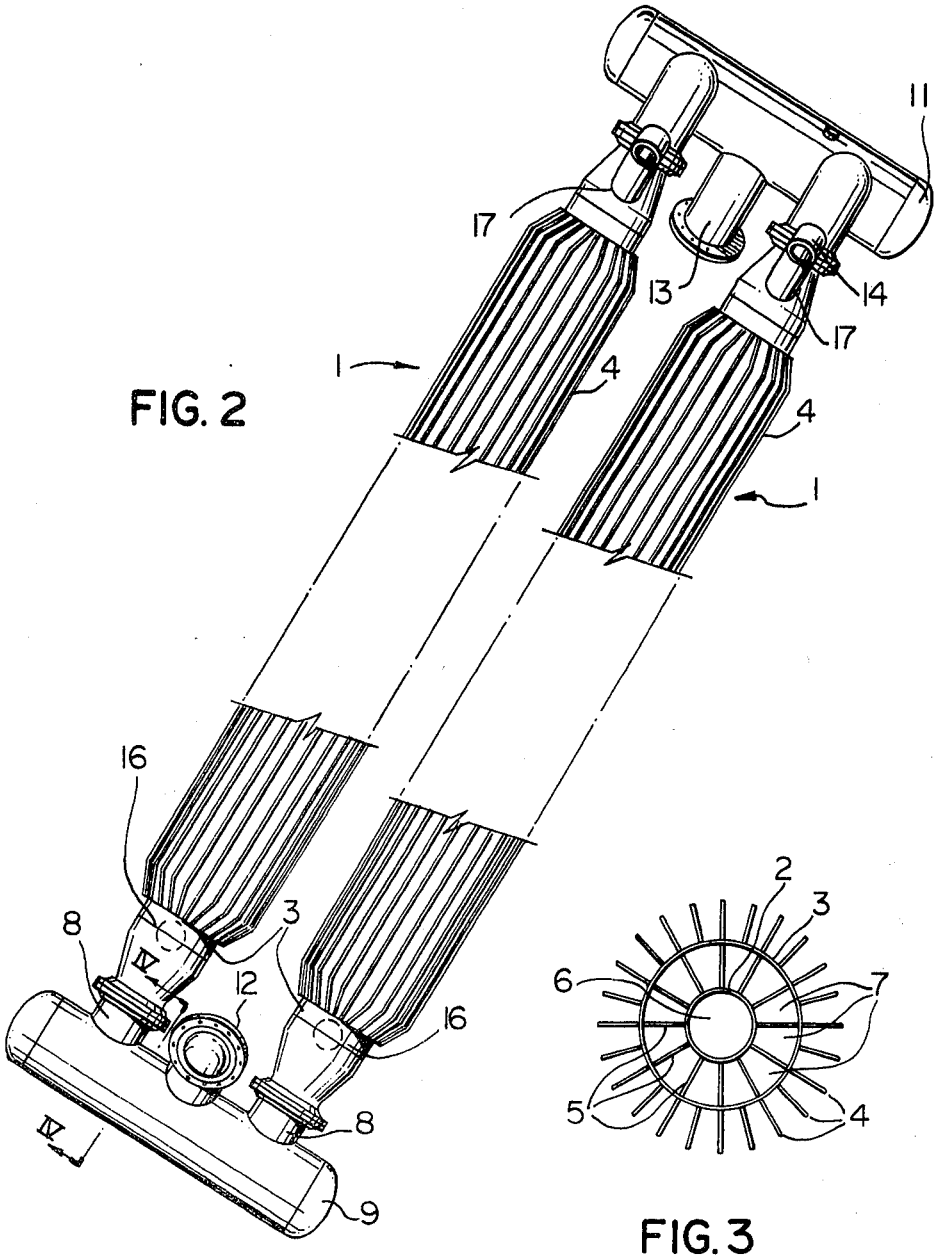
FIG. 2 is a top plan view of two such assemblies arranged in parallel.
FIG. 3 is a cross sectional view taken along the line III—III of FIG. 1.

With particular reference to FIGS. 1 and 3, it will be seen that tubular section 2 along its substantial length of assembly 1 defines an internal or first passageway 6. An enveloping outer or second passageway which is annular in cross section is defined between tubular sections 2 and 3. This second passageway 7 may in fact be composed of a multiplicity of annularly arranged longitudinal chambers which are separated by spacing rib 5 as best seen in FIG. 3.

Assembly 1 is preferably positioned in an inclined position as illustrated in FIG. 1. As seen in the cut-away of this drawing, at its bottom end, inner tubular section 2 by means of curved elbow 15 is caused to extend through and outwardly of outer tube section 3. In a like manner, elbow arrangement 14 connected to inner tubular section at its top end similarly passes through and extends outwardly from tubular section 3 at 17. Elbow components 14 and 15 effectively are extensions of inner tubular section 2 but are sealed off from the second passageway 7 where they extend through tubular section 3 at points 16 and 17. Elbow 15 is coupled to manifold 18 which is in communication with header 19. As will be apparent, header 19 can function as a common distribution unit where two or more assemblies 1 are arranged in parallel as discussed in greater detail hereinbelow with regard to pressurized gas header 9. Suffice it to say, for each given assembly 1, a cooling fluid such as a refrigerant, air, water or the like can be introduced into the assembly via supply pipe 20, header 19, manifold 18 and elbow 15 at its bottom end and discharged at the top end through elbow arrangement 14. It will also be appreciated that the cooling fluid which passes internally of assembly 1 through tubular section 2 can be reversed in the sense that it enters assembly 1 via elblow 14 and is discharged therefrom at its opposite end via elbow 15. Where ambient air is employed as the cooling fluid, for example, a suitable air fan (not shown) can be connected to supply pipe 20 to draw or force air through supply tube 2.

The lower or "hot" end of assembly 1 and more particularly outer tube section 3, is connected to an inlet manifold 8 as best seen in FIGS. 1, 2 and 4. In an application where two or more assemblies 1 are arranged in parallel as illustrated, each inlet manifold 8 is connected to and communicates with an inlet header 9 which in turn communicates with supply pipe 12 which itself is connected downstream of a compressor for the continuous passage of compressed gas therethrough (not shown).

In a somewhat similar manner, the top or "cold" end of assembly 1 and more particularly tube section 3 is connected to a compressed gas outlet manifold 10 which communicates therewith and with outlet header 11. Compressed gas discharge pipe 13 is attached to and communicates with header 11. Discharge pipe 13 is in turn connected to an ongoing conduit (not shown).

As best seen in FIG. 1, a supply of compressed gas at an elevated temperature can be introduced internally of outer tubular section 3 via supply pipe 12, inlet header 9 and inlet manifold 8 and at its other end discharged via outlet manifold 10, outlet header 11 and discharge pipe 13. Outer tubular section 3 in the embodiment illustrated functions as a heat exchanger between the pressurized gas passing therethrough and the ambient functioning as the cooling fluid. Heat exchange is further promoted by means of ribs 5 on the exterior surface of tubular section 3. Heat exchange also takes place between the compressed gas flowing through passageway 7 and the cooling fluid, for example air at ambient temperature, passing through passageway 6 of inner tubular section 2. As illustrated, this interior form of heat exchange is further promoted by means of spaced apart longitudinal ribs 5 positioned between inner tubular section 2 and outer tubular section 3.

It will be evident that the compressed gas entering the lower or "hot" end of the assembly is caused to cool as it proceeds upwardly along inclined passageway 7 since it is in heat exchange with the cooling fluid located externally of tubular section 3 and internally of tubular section 2. Applying the cold temperature approach, at some point along its upward traverse of passageway 7, the compressed gas will be sufficiently cooled so that its dew point temperature will be in equilibrium with the temperature of the cooling fluid thereabout and condensate will appear within tubular section 3 at or slightly above this point. The condensate so formed tends to collect internally of and along the lowermost inclined portion of passageway 7 or when ribs 5 are used as illustrated in the drawings, the lowermost portion of each of these ribs. The gravitational effect on the accumulated condensate is such that it flows downwardly towards the lower or "hot" end of assembly 1.

As best seen in FIGS. 1 and 4, the condensate which is moving in counter flow direction to the flow of the compressed gas moves downwardly of tubular section 3 and inlet manifold 8 and collects within header 9.

The particular condensate discharge means illustrated, within header 9, employs a drain 24 located centrally of and on the underside of header 9 through which the collected condensate can be discharged. With reference to FIG. 4 and in order to further promote downward counter flow of the collected condensate along the lowermost inclined portion of tubular section 3 and inlet manifold 8, a transverse sub-floor 21 is positioned in the bottom of header 21 above drain 24. Vertical transverse baffle 22 is attached to sub-floor 21 as shown in FIG. 4 with a plurality of holes 23 arranged along the length of sub-floor 21 to the right of baffle 22 for the passage of condensate therethrough and ultimate discharge from header 9 through drain 24. Collected condensate is, above sub-floor 21, confined to the right of baffle 22. It is also believed that this baffle 22, on its right, contributes to a negative pressure environment relative to the remainder of the pressurized gas introduced into header 9 via inlet supply pipe 12 and thus further contributes to condensate collection for the purpose of ultimate discharge.

When operating the condensor with compressed air and using very cold ambient air as the cooling fluid, the discharge temperature of the compressed air at the cold end has been observed to be well below the freezing point of water (0° C.). Indeed, a freezing line may occur at a point along passageway 7 but the buildup of ice above this point does not appear to adversely effect its overall performance. It is suspected that as the passageway becomes choked, the velocity of compressed air passing through this confining area is increased resulting in ongoing thawing of the ice buildup, thus rendering it self-regulating. Further, a balancing of the ice buildup between two or more assemblies operating in unison is also believed to take place, ensuring continuous operation in adverse cold weather conditions.

As various changes can be made to the specific working embodiment described herein without departing from the scope of the invention, it is to be understood that this working embodiment is illustrative only and is not advanced in a limiting sense and scope of the subject invention being set forth in the subjoined claims.

What I claim as my invention is:

1. A vapour condensing apparatus for continuously collecting condensate subject to the freezing from a supply (12) of compressed gas passing therethrough wherein the temperature dew point of the vapour in the compressed gas is greater than the temperature of the cooling fluid, said apparatus comprising at least one elongate condensing assembly having a top end and a bottom end and wherein each said assembly includes spaced apart inner (2) and outer (3) tubular sections which extend directly between said ends, a first passageway (6) in said assembly for the passage of the cooling fluid therethrough and which is defined by the interior of said inner tubular section (2), a second passageway (7) in said assembly for the passage of the said compressed gas therethrough and which is defined by the spacing between said spaced apart inner (2) and outer (3) tubular sections, compressed gas inlet manifold means (9) communicating with said second passageway (7) at said bottom end, compressed gas outlet manifold means (10, 11) communicating with said second passageway (7) at said top end and condensate discharge means (24) at the bottom end of said assembly for exhausting condensate collected in said second passageway (7) and draining therethrough by gravity to the compressed gas inlet manifold means and being prevented from freezing by the presence of the compressed gas supplied from the manifold prior to being cooled by the cooling fluid.

2. The vapour condensing apparatus as claimed in claim 1, which further includes a plurality of said condensing assemblies which are arranged in parallel and wherein the compressed gas inlet manifold means of each assembly is included within a common compressed gas inlet header and the compressed gas outlet manifold means of each assembly is included within a common compressed gas outlet header.

3. The vapour condensing apparatus as claimed in claim 1, including fan means for passing ambient air as said cooling fluid through said first passageway.

4. The vapour condensing apparatus as claimed in claim 2, including fan means for passing ambient air as said cooling fluid through said first passageway.

5. The vapour condensing apparatus as claimed in claim 1 wherein said condensate discharge means is located in said compressed gas intake manifold.

6. The vapour condensing apparatus as claimed in claim 2 wherein said condensate discharge means is located in said compressed gas intake manifold.

7. The vapour condensing apparatus as claimed in claim 1 wherein said compressed gas is compressed air and said condensate is water.

8. The vapour condensing apparatus as claimed in claim 2 wherein said compressed gas is compressed air and said condensate is water.

9. The vapour condensing apparatus as claimed in claim 1 wherein the outer surface of said outer tubular section 3 of each said assembly includes a plurality of cooling fins thereon.

10. The vapour condensing apparatus as claimed in claim 2 wherein the outer surface of said outer tubular section of each said assembly includes a plurality of cooling fins thereon.

11. A method for continuously extracting vapour condensate subject to freezing from a throughput of compressed gas wherein the temperature dew point of the vapour in the compressed gas is greater than the temperature of a cooling fluid, said method comprising passing said compressed gas at a predetermined velocity through an upwardly extending and inclined passageway from the bottom thereof, which passageway is in heat-exchange with said cooling fluid to thereby form condensate in the throughput of compressed gas, permitting said condensate to flow down said passageway in counterflow direction to that of the compressed gas, said condensate being maintained in liquid condition and prevented from freezing by the presence of the compressed gas supplied to the inclined passageway from the bottom thereof and prior to having been cooled by the cooling fluid, and withdrawing said condensate at the bottom of said inclined passageway.

12. The method as claimed in claim 11, wherein said compressed gas is compressed air and said condensate is water.

13. The method as claimed in claim 12, wherein said cooling fluid is ambient air.

14. The method as claimed in claim 11, wherein the heat exchange of said compressed gas with said cooling fluid takes place internally and externally of said passageway.

15. In combination with a system to make "man-made snow", a vapour condensing apparatus for removal of water vapour from a supply (12) of compressed air, in which the water vapor is subject to freezing due to exposure of the apparatus to ambient conditions below 0° C., said apparatus comprising at least one elongate condensing assembly having a top end and a bottom end, and wherein each assembly includes spaced-apart inner (2) and outer (3) tubular sections which extend directly between said ends;

a first passageway (6) in said assembly for the passage of ambient air and forming a cooling fluid therethrough, said passageway being defined by the interior of said inner tubular section (2);

a second passageway (7) in said assembly for the passage of compressed air therethrough, and having water vapour entrained therein, said second passageway being defined by the spacing of said spaced-apart inner (2) and outer (3) tubular sections, compressed air inlet manifold manifold means communicating with said second passageway (7) at said bottom end;

compressed gas outlet manifold means (10, 11) communicating with said second passageway (7) at said top end;

and condensate discharge means (24) located at the bottom end of said assembly for removal of condensate collected in said second passageway (7) and flowing downwardly, by gravity, to the compressed air inlet manifold means and being prevented from freezing by the presence of the compressed air supplied to the compressed air inlet manifold prior to being cooled by the ambient air cooling fluid within the first passageway (6).

16. Apparatus according to claim 15, which further includes a plurality of said condensing assemblies which are arranged in parallel and wherein the compressed air inlet manifold means of each assembly is included within a common compressed air inlet header and the compressed air outlet manifold means of each assembly is included within a common compressed air outlet header.

17. Apparatus according to claim 15, wherein the outer surface of said outer tubular section (3) is exposed to ambient air.

18. Apparatus according to claim 15, wherein the outer surface of said outer tubular section (3) of each said assembly includes a plurality of cooling fins thereon.

19. Apparatus according to claim 15, including forced air circulation means for passing the ambient air forming said cooling fluid through said first passageway (6).

20. Apparatus according to claim 15, wherein said condensate discharge means is located in said compressed air intake manifold.

* * * * *